United States Patent [19]

Young, Jr.

[11] Patent Number: 4,766,719

[45] Date of Patent: Aug. 30, 1988

[54] APPARATUS AND METHOD FOR DETWISTING A MOVING FABRIC

[75] Inventor: William O. Young, Jr., Spartanburg, S.C.

[73] Assignee: Young Engineering, Inc., Spartanburg, S.C.

[21] Appl. No.: 107,013

[22] Filed: Oct. 13, 1987

[51] Int. Cl.[4] ..... D06C 3/06; D06C 29/00

[52] U.S. Cl. ..... 57/1 UN; 57/31; 8/151

[58] Field of Search ..... 57/1 R, 1 UN, 31, 264; 26/1, 74, 99; 8/151

[56] References Cited

U.S. PATENT DOCUMENTS

| | | | |
|---|---|---|---|
| 2,759,324 | 8/1956 | Dean | 57/1 UN |
| 2,836,012 | 5/1958 | Moorhouse et al. | 57/1 UN |
| 3,813,862 | 6/1974 | Tsuchida | 57/1 UN |
| 4,106,004 | 8/1978 | Kuroda | 57/1 UN X |
| 4,286,428 | 9/1981 | Bassani | 57/1 UN |
| 4,329,838 | 5/1982 | Zerle | 57/1 UN |
| 4,631,911 | 12/1986 | Young et al. | 57/1 UN |

FOREIGN PATENT DOCUMENTS

| | | | |
|---|---|---|---|
| 677647 | 8/1952 | United Kingdom | 57/1 UN |

*Primary Examiner*—Donald Watkins
*Attorney, Agent, or Firm*—Dority & Manning

[57] ABSTRACT

Apparatus and method for removing real or false twist from a moving fabric in rope form. Fabric is moved along a first path followed by second and third generally vertical paths which define a fabric loop. A twist removal device is located along the first fabric path to remove twist from the fabric. A fabric opening or spreading unit is located along or downstream of said third path with a twist detector located between the fabric opening unit and the nadir of the fabric loop, preferably adjacent the location where the fabric is just begins to spread for detecting direction and magnitude of any twist remaining in the fabric. Controls are operatively associated with the twist detector means and the twist removal device to control further twist removal responsive to detected remaining twist in the fabric.

A preferred twist detector includes spaced parallel cylindrical rolls contactable with the fabric rope on opposite sides thereof. The rolls are supported on longitudinal angularly disposed axles for movement therealong by twist in the fabric.

20 Claims, 5 Drawing Sheets

APPARATUS AND METHOD FOR DETWISTING A MOVING FABRIC

BACKGROUND OF THE INVENTION

The present invention relates to a method and apparatus for the removal of real or false twist from a moving fabric in rope form.

Fabric that is subjected to finishing and/or dyeing processes in rope form such as in a jet dyer or the like is subject to receiving real or false twist during such processing. Thereafter, upon removal of the fabric from the processing equipment, it is necessary to open the fabric to its full width so that it can be properly fed to a tenter frame or the like for drying and/or heat setting of the fabric. Either false twist or real twist in the fabric while in rope form, will create problems during the opening of the fabric in preparation to feeding the fabric in open width to other processing equipment, particularly, where the fabric is in rope form and loosely stored in a container. A single end of the fabric is removed from the container for opening to its full width. During such opening operation, spreading forces will cause any real or false twist therein to move along the fabric rope in a direction opposite to the direction of opening. If too much twist is present in the fabric, the fabric will ultimately fail to open properly.

The present invention is designed to remove such real or false twist from fabric in rope form prior to spreading it, irrespective of the degrees of twist in the fabric, while at the same time enabling the process to continue unimpeded.

Various and sundry devices are known for use in removing twist from fabrics. One such device is described in commonly assigned U.S. Pat. No. 4,631,911 which is effective in removing twist from a moving fabric in rope form. It has now been found, that whenever fabric in rope form is transported and in a portion of its path moves vertically downwardly, any twist in the fabric drops quickly to the bottom of the vertical path. Further, if such fabric forms a U-shaped loop at the lower end of the vertical leg, the twist tends to accumulate around the nadir of the U-shaped loop. Apparently the force of gravity tends to cause any such remaining twist in the fabric to gravitate towards the nadir of the loop.

It has now been found that an optimum and preferred position for measuring twist remaining in a fabric following a path as defined above in which a U-shaped loop is present in the path is at a point between the nadir of the fabric loop and a downstream fabric spreading mechanism.

No prior art is known that teach or suggest the apparatus or method of the present invention.

SUMMARY OF THE INVENTION

It is an object of the present invention to provide apparatus for the accurate removal of twist from a moving fabric in rope form.

Another object of the present invention is to provide an apparatus for the removal of both real and false twist from a moving fabric in rope form which is adjustable in response to the type and the amount of twist in the fabric.

Another object of the present invention is to provide an improved system for removing twist from a moving fabric in rope form under low tension conditions.

Yet another object of the present invention is to provide an improved method for removing twist from a moving web.

Generally speaking, apparatus according to the present invention for removing twist from a fabric in rope form comprises means for moving said fabric along a first path; means for receiving said fabric from said first path and for directing said fabric in a downwardly vertical path; means for lifting said fabric from its downward path along an upward path, whereby a generally vertical U-shaped loop of said fabric is formed along said path between said lifting means and said receiving means; means located downstream of a nadir of said loop portion of said fabric path for opening said fabric to its full width; means disposed along said first path of said fabric travel for engaging said fabric and for removing twist therefrom; means disposed along said U-shaped loop of fabric at a point between the nadir of said loop and said lifting means for detecting the presence of and measuring the amount and the direction of twist remaining in said fabric; and means responsive to said detecting means for controlling said twist removal means.

More specifically, the detwisting apparatus of the present invention for removing twist from said fabric comprises a first freely rotatable element located adjacent one side of a path of the fabric travel, and a second freely rotatable element positioned diagonally as to the first rotatable element adjacent an opposite side of the path of the fabric travel. Both of the rotatable elements have fabric engaging means helically received therearound, and are capable of relative adjustment with respect to the fabric passing in contact therewith. Such detwisting apparatus is disclosed in U.S. Pat. No. 4,631,911 though any other suitable detwisting apparatus may be employed.

The detector means employed to ascertain the existence and the direction of any twist remaining in the fabric after its passage through the detwisting means is located downstream of the means for removing twist. The remaining twist detecter is operatively associated with the detwisting apparatus to indicate the appropriate direction and amount of correctional adjustment whenever any such adjustment is dictated. One detecting means is disclosed in U.S. Pat. No. 4,631,911 or it may take the form of any other suitable twist detecter.

The fabric after passing through the detwisting mechanism or apparatus, passes over a pull reel assembly and is directed thereby into a vertical U-shaped loop, and from thence to a fabric spreading or opening device. The twist detecter, whether it be the one from U.S. Pat. No. 4,631,911 or another suitable twist detecter or the preferred twist detecter as disclosed herein, is located at a point between the nadir of the U-shaped loop and the fabric opener or spreading mechanism. Preferably, the twist detecter is located as near as possible to the point where the fabric begins to spread out from the rope form as it leaves the loop. This point is always located on the upward leg of the U-shaped loop of the fabric at a point between the nadir of the loop and the fabric spreading device.

The remaining twist detecter may be a plurality of photocells that determines the degree of openness of the fabric at the particular location at which it is placed, and is operatively associated with the fabric detwisting unit, and also preferably with a turntable on which a container or truck of fabric is located upstream from the detwisting unit. Depending upon the degree of openness of the fabric at the sensor or detector location, the detwisting unit will remain unchanged or will be further oriented in a direction indicated by the direction and magnitude of twist detected to provide for appropriate twist removal from further fabric being processed. Further, should an adequate amount of real twist remain in the fabric, rotation of the turntable will also be implemented in a direction opposite to the detected twist to further assist in the twist removal.

A preferred remaining twist detector includes a pair of rotatable cylinders or rolls which are located on opposite sides of the fabric and in a nipping contact therewith. The rolls are received for free axial movement on axles disposed at an acute angle with respect to the path of fabric travel. Electrical sensors or the like are provided and are operatively connected with a control means. Location of the rolls on their respective axles determines the direction and magnitude of any remaining twist in the fabric and thus provides input to the control means for adjustment of the twist removal means, if necessary.

Generally speaking, the method according to the present invention comprises the steps of moving said fabric along a first path; moving said fabric along a second path in a downward vertical direction for a predetermined distance; moving said fabric along a third path in an upward vertical direction, whereby said second and third paths form a fabric loop therebetween; spreading said fabric to its full open width downstream of the nadir of said loop; detecting any twist remaining in said fabric in its third path, after it passes through the nadir of said loop and before said rope is spread to its full width; and controlling said twist removal means in response to twist detected in said fabric in said third path.

DETAILED DESCRIPTION OF THE DRAWINGS

Figure 1:
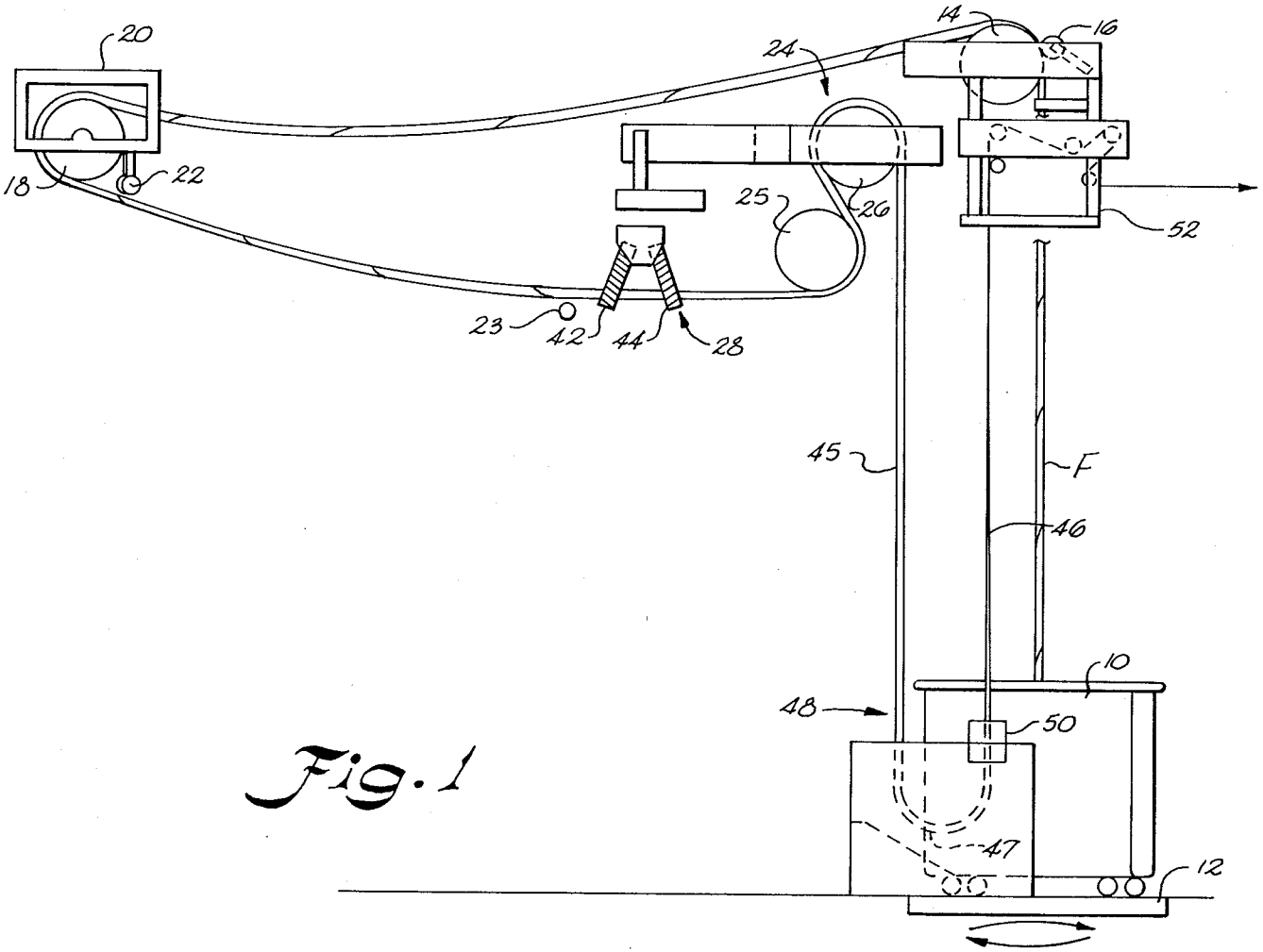
FIG. 1 is a schematic side elevational view of apparatus for removing twist from a moving fabric in rope form under low tension conditions according to the teachings of the present invention.
Figure 2:
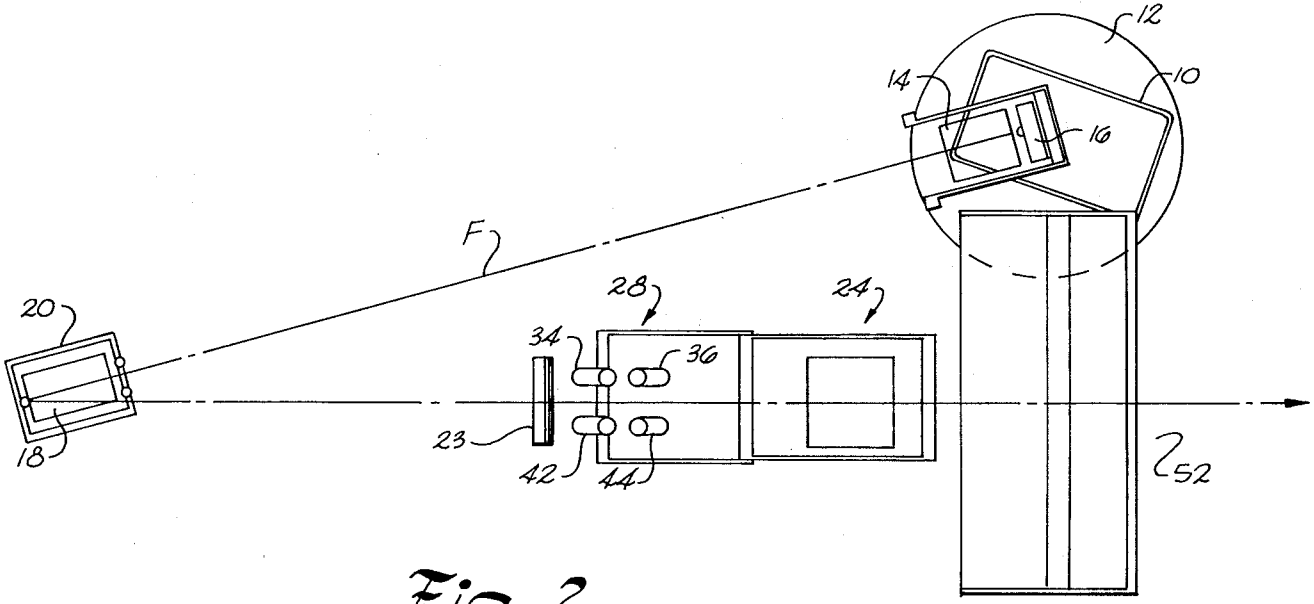
FIG. 2 is a plan view of the apparatus illustrated in FIG. 1.
Figure 3:
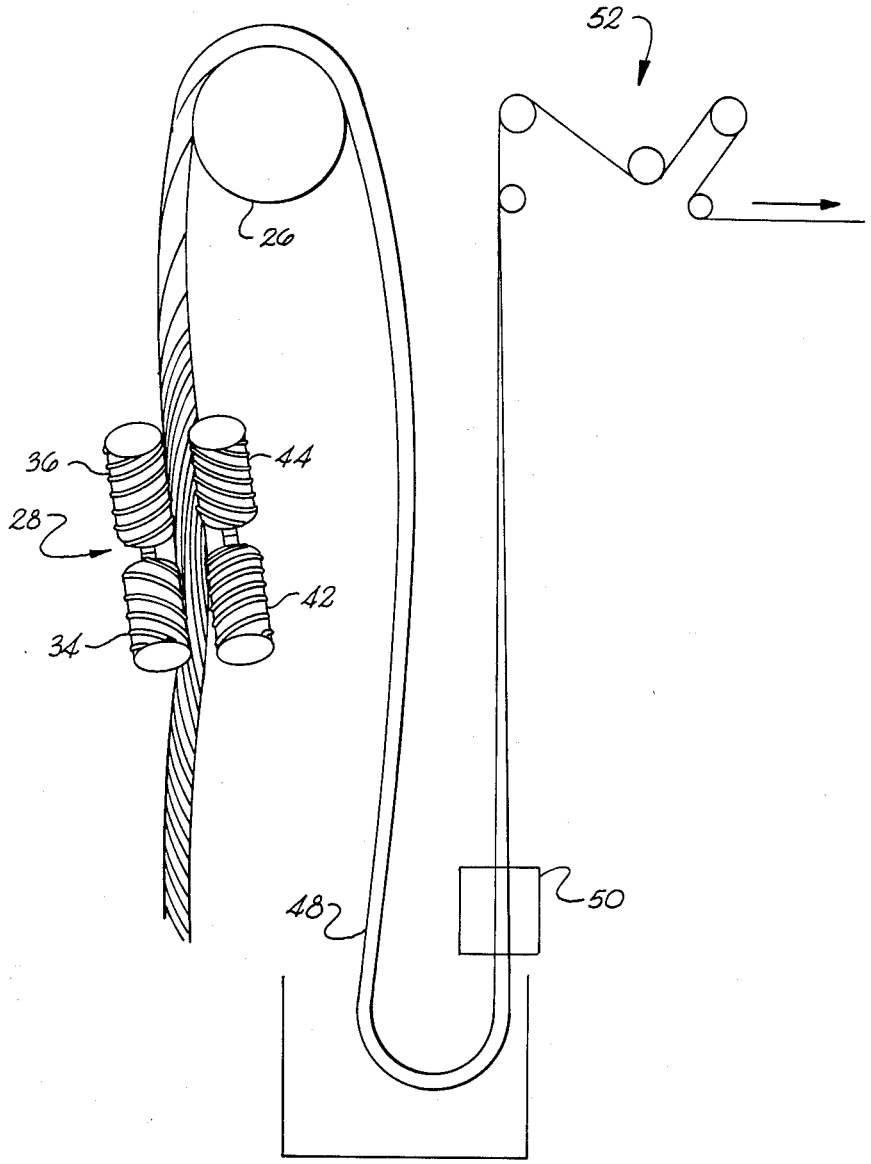
FIG. 3 is a schematic illustration of the apparatus and process or method of the invention.

Referring now to the drawings, the present invention will be described in detail. FIGS. 1, 2 and 3 illustrate the preferred arrangement of the apparatus according to the present invention for the removal of twist from a moving fabric in rope form under low tension conditions, and is particularly appropriate for fabric that would be adversely affected by tension. Fabric F is shown threaded through the apparatus originating in a loose form in a fabric truck or container 10 which rests upon a turntable 12, the purpose of which will be described hereinafter. Fabric F is removed from within the container 10 by fabric lifting entry reel 14 along a generally vertical path. Cooperating with lifter reel 14 is a squeeze roll 16 which assists in the lifting of the fabric from its container, and also serves to squeeze any excess liquid remaining in the fabric therefrom. After passing over fabric lifting reel 14, fabric F moves in a generally horizontal path to an intermediate reel 18 which is mounted on a support housing 20. Fabric F extends about the intermediate reel 18 and generally reverses its direction in a second generally horizontal path to a pull reel assembly generally 24. Pull reel assembly 24 comprises a lower pull reel 25 and an upper pull reel 26 with fabric F extending about the lower and upper reels, respectively, in a generally S-shaped path.

At a point between pull reel assembly 24 and the intermediate reel 18 is located a detwisting unit generally 28. Detwisting unit 28 may comprise two pairs of rolls 34, 42 and 36, 44, as best seen in FIG. 3. Further details of the detwisting unit 28 are illustrated and described in U.S. Pat. No. 4,631,911 which is incorporated herein by reference. It will also be understood that any other suitable detwisting unit may be used instead of that illustrated herein or that disclosed in U.S. Pat. No. 4,631,911. Hence, fabric F passes along a path of travel from reel 14 to reel 18 where it reverses direction. Guide rollers 22, 23 maintain fabric F in a proper path for same to be subjected to the influence of detwist unit 28.

After fabric F leaves detwist unit 28 and passes over the upper reel 26 of pull reel assembly 24, fabric F is permitted to freefall along a vertical path 45 which defines a portion of a vertical U-shaped loop 48 having a nadir or lower portion 47 and an upper vertical leg 46. Downstream of fabric loop 48 fabric F is engaged by a fabric spreader or opener 52 which pulls fabric F from loop 48 and spreads or opens up the fabric to its full width. The opening process is a gradual one and the width of the fabric from the opener or spreader will run backwards towards the nadir 47 of the fabric loop 48 at which the rope of fabric begins to open up.

It has been found that twist remaining in the fabric after its passage through the detwisting apparatus 28 drops quickly along leg 45 of loop 48 to the vicinity of nadir 47 and accumulates thereat. Twist in fabric F that has accumulated at the nadir 47 or bottom of loop 48 tends to runs past nadir 47 of a loop to the point at which the rope of fabric begins to open up or to spread towards its full width. It has been unexpectedly found that the most accurate and consistent point to accurately measure twist remaining in fabric F is between the nadir of the loop and spreading device, and preferably in the vicinity of the bottom of the loop. It is at this point that twist detecter 50 is located in accordance with the present invention. Twist detecter 50, as noted above, may be in the form shown and illustrated in U.S. Pat. No. 4,631,911 or any other suitable twist detecter which detects the amount of twist and its direction may be used.

After fabric F leaves twist detecter 50 it traverses into the fabric spreader or opener 52, which may be the spreader or opener disclosed in U.S. Pat. No. 4,631,911 or in U.S. Pat. No. 4,068,789, the disclosure of these patents is incorporated herein by reference. However, it is to be understood that any commercial fabric spreader means may be used to accomplish this purpose.

Figure 5:
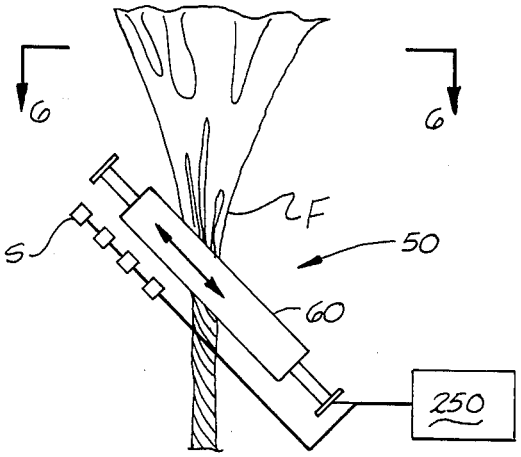
FIG. 5 is a side elevation of a twist detecting device used in the invention.
Figure 6:
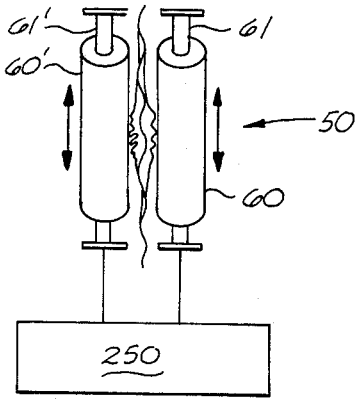
FIG. 6 is a plan view of the twist detecting device illustrated in FIG. 5, taken along lines 6—6 of FIG. 5.

Referring now to FIGS. 5 and 6 of the drawings wherein a preferred twist detector 50 is illustrated. Twist detector 50 includes a pair of rotatable cylinders 60, 60' which engage opposite sides of the fabric while it is still in rope form at the area where it begins its transition from rope to open width form. Cylinders 60, 60' are inclined at an acute angle to the longitudinal axis of the fabric rope, being mounted on axles 61, 61' which permit each of the rolls to move independently along its longitudinal axis in response to the twisting or turning movement of the fabric. A preferred angle is about 45 degrees with respect to vertical. As the fabric is spread by the spreading device, all twist remaining in the fabric tends to run backwards towards nadir 47 of loop 48 and through cylinders 60, 60'. If the fabric has twist which causes the fabric in rope form to rotate in the counter-clockwise position, (as seen in FIG. 6,) roll 60 will tend to move downward along its longitudinal axis and roll 60' will tend to move upward along its longitudinal axis. A program controller 250 is operatively associated with cylinders 60, 60' and/or the respective axels 61, 61' through appropriate sensors for detecting and measuring the position of said rolls along their longitudinal axes. Program controller also then converts signals received from cylinders 60 and 60' into a signal which indicates the direction and the magnitude of any twist remaining in the fabric at the point where it begins its transition from rope form to spread form.

In the event that the twist present in the fabric causes the rope to revolve in the clockwise direction (as seen in FIG. 6,) cylinder 60' will move downward and cylinder 60 will move upward along their longitudinal axes. Again, program controller 250 will convert signals generated by their positions into a signal which indicates the direction of twist and the magnitude of twist remaining in the fabric in its rope form.

Program controller 250 after receiving input from twist detector 50 will, after appropriate comparison with detwist unit 28 and/or turntable 12, effectuate such change as is necessary for detwist unit 28 and/or turntable 12 to modify the twist removal from further lengths of fabric F being processed.

The position of said rolls 60, 60' along their respective axles can be detected by a series of switches S (see FIG. 5) which are opened and closed as the rolls move along their longitudinal axes. Since only one of the cylinders 60, 60' would be moved upwardly, a single set of switches located for actuation by either would generally suffice. Proximity switches, for example, could be employed, to be energized by pressure of a top of the cylinders. Another means to detect the position of the rolls or cylinders would be to provide capacitance plates on the opposite sides of the axles. Many other alternative means for detecting and measuring said positions will be readily apparent to those skilled in the art.

In the event that the fabric has no twist, both rolls or cylinders 60 and 60' will occupy a down position and the program controller will indicate zero twist therein.

Figure 4:
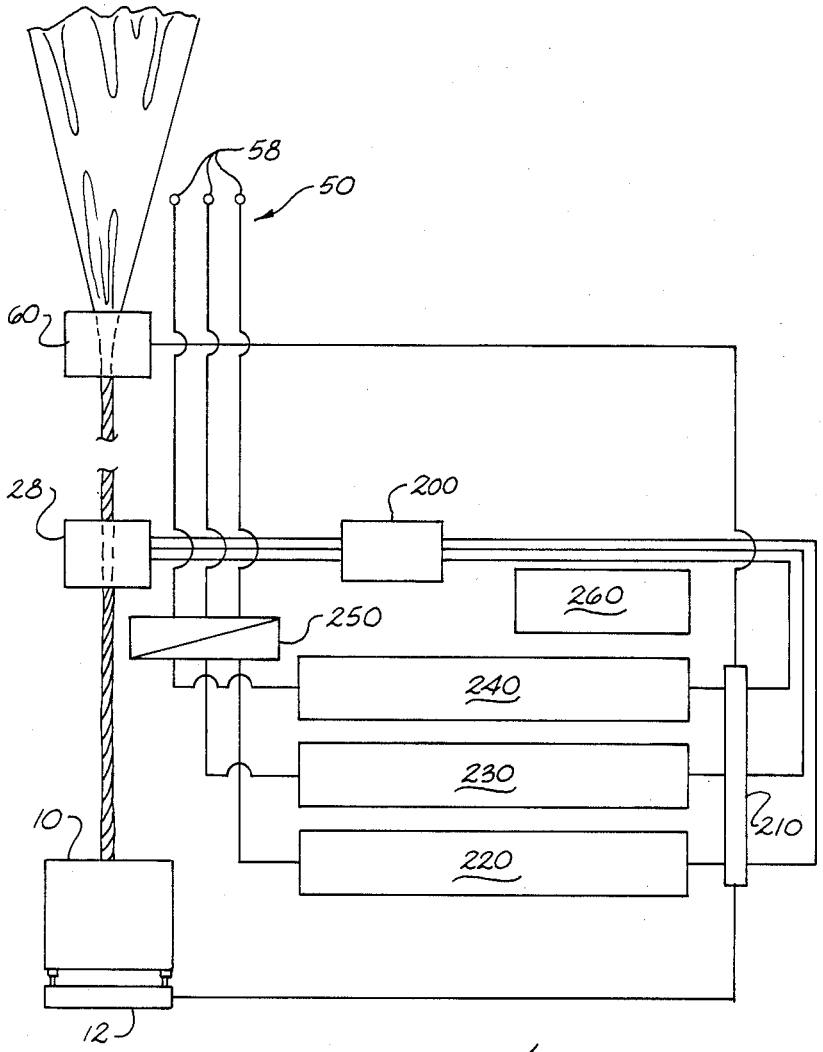
FIG. 4 is a control logic diagram for the apparatus of the present invention.
Figure 7:
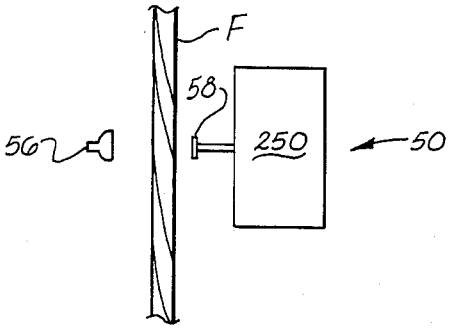
FIG. 7 is a side elevation of a further twist detector embodiment according to the present invention.

FIGS. 4 and 7 illustrate another twist detecting apparatus which is located at the point along loop 46 where fabric F begins to open up from the rope to the spread condition. In this embodiment of the twist detector, one or more light sources 56 are disposed on one side of the path of fabric travel with a plurality of light sensors 58 disposed on the other side of the fabric path. Fabric F is disposed between the light sources and the sensors and where the fabric is completely spread, all of the sensors will fail to detect the light due to the intervention of the fabric therebetween as shown in FIG. 7. As the twist increases in the fabric, more of sensors 58 will be exposed to the light generated by light sources 56 and the signals generated by sensors 58 are transmitted to a program controller 250 where, in turn, the number and the location of the sensors detecting the light source will be utilized by the program controller to indicate the amplitude of twist remaining in the fabric. When such a twist detector arrangement is employed, a further means should be employed in conjunction therewith to determine the direction of remaining twist, such as is described in U.S. Pat. No. 4,631,911.

FIG. 4 schematically illustrates the operative association between the control elements of the present invention. The particular electrical components or circuitry of the system are not illustrated since actual construction of the circuit from the information provided herein is believed to be within the realm of those skilled in the art. As shown in FIG. 4, the rotational position of detwister 28 is dictated by control unit 200, both as to the amount and the direction of rotation. The control unit could, for example, be a pneumatic actuator operatively associated with the support for the detwister unit. Where none of the light sensors 58 are uncovered, the fabric F remains in the adequately twistless state so that no corrective measures are required, even if the twist direction detector 60 indicates the presence of twist. Under such conditions, the detwist unit 28 remains in a neutral mode. Exposure of photocells 58 indicates remaining twist sufficient to justify correction. Signals generated by photocells 58 thus actuates control actuator 220 to 240, depending upon the number of photocells exited and provides an input signal to unit 200 indicating need for a particular degree of rotation for the detwisting unit 28. Twist direction detector 60 will also input the appropriate direction of rotation. Control unit 200 will then follow the input command and, will rotate the detwist unit 28 by an appropriate amount in a counter-clockwise or clockwise direction depending on the twist detected. Further corrective action could come about to also actuate rotation of turntable 12 in a direction determined by the twist direction detector 60. With a control unit as shown schematically in FIG. 4, the amount and timing of rotation may be adjusted according to the dictates of the overall system. For example, while for a detwist unit 28, as illustrated in FIGS. 1 and 3, six and one-half and thirteen degree rotational increments are generally appropriate, such amounts may, of course, vary. In like manner, an infinitely variable adjustment system could be employed. It is, of course, preferred that the detwisting unit 28 not undergo continuous adjustment. Accordingly, a time delay unit 250 is preferably located between the twist detector (photocells 58) and the individual control actuators 220, 230 and 240, to afford a flutter dampening characteristic for the system. In other words, a delay occurs between exposure of the photocells and input to the control unit 200 to ensure that the twist condition is removed and that the exposure of the photocells did not result from the fabric fluttering or the like.

Should the twist detecter 50 indicate a need for a correctional adjustment of the detwisting unit 28, to remove more or less twist, care must be taken to ensure that a false reading has not been obtained, thus avoiding undesirable oscillation. A control circuit 210 is thus provided in control unit 200 to avoid change resulting from false readings or sensings.

As seen in FIG. 1, the fabric spreader or opener 52 is not located immediately downstream from pull reel assembly, but is separated therefrom by a loop of fabric 48. The length of this loop may be controlled by a loop control device (not shown) as described in U.S. Pat. No.

4,631,911. Such technology is well known in the art and a preferred system for the loop control is described and claimed in U.S. Pat. No. 3,949,281, the description of which is incorporated by reference herein.

In operation according to the present invention, a quantity of fabric F in rope form is threaded through the apparatus. Fabric F is then drawn by reels 14, 24 and 52 (or some downstream drive means). As fabric F passes by detwist unit 28, twist therein is removed dependent upon the settings of detwist unit 28. After leaving detwist unit 28, fabric F passes about reels 25, 26 and drops vertically along leg 45 of fabric loop path 48. Any twist then remaining in fabric F immediately drops, moving down fabric F to the bottom or nadir 47 of fabric loop 48. Any remaining twist in fabric F thus accumulates about nadir 47. As fabric F is pulled upwardly from loop nadir 47 and subjected to a spreading action, fabric F is subjected to a detector means 50 for ascertaining the magnitude and direction of the remaining twist. Remaining twist detector means 50 is operationally connected to control means 250 which receives input as to the direction and magnitude of any remaining twist and institutes corrective change to detwist unit 28 and/or turntable 12, if necessary, to effectuate proper twist removal from further fabric F to be processed, attempting to achieve full twist removal from fabric F.

Having described the present invention in detail, it is obvious that one skilled in the art will be able to make variations and modifications therein without departing from the scope or essence of the invention. Accordingly, the scope of the present invention will be determined only by the scope of the claims appended hereto.

What is claimed is:

1. Apparatus for handling a moving fabric in rope form for removing twist therein and for opening up said fabric, comprising:

(a) means for moving said fabric along a first path;

(b) means for receiving said fabric from said first path and for directing said fabric in a downwardly vertical path;

(c) means for lifting said fabric from its downward path along an upward path, whereby a generally vertical U-shaped loop of said fabric is formed along said path between said lifting means and said receiving means;

(d) means located downstream of a nadir of said loop portion of said fabric path for opening said fabric to its full width;

(e) means disposed along said first path of said fabric travel for engaging said fabric and for removing twist therefrom;

(f) means disposed along said U-shaped loop of fabric at a point between the nadir of said loop and said lifting means for detecting the presence of and measuring the amount and the direction of twist remaining in said fabric; and (g) means responsive to said detecting means for controlling said twist removal means for removing twist in further fabric to be processed thereby.

2. Apparatus as set forth in claim 1, wherein said twist removal means comprises a pair of freely rotatable elements located along each side of said fabric path, each of said rotatable elements having means thereon for contact with said fabric as said fabric moves thereby, whereby rotation of said elements removes twist from said fabric.

3. Apparatus as set forth in claim 1 wherein said twist detecting means comprises a pair of cylindrical elements for receiving said fabric therebetween, each said cylindrical element being freely rotatably received on respective axels and for axial movement therealong, said axels being generally vertically disposed at an angle with respect to said fabric path thereat, whereby fabric passing therebetween with twist will move one of said elements upwardly along its axle, dependent upon the direction and magnitude of twist remaining in said fabric, and further comprising means associated with said elements for sensing the location of same along said axle, said sensor means being operatively associated with said control means.

4. Apparatus as set forth in claim 1, wherein said remaining twist detecting means is located at the area where said rope of fabric begins to leave said fabric loop path and starts to spread to its full width.

5. Apparatus for handling a moving fabric in rope form under low tension conditions and for opening said fabric, comprising:

(a) means for pulling said fabric along a first path and permitting said fabric to fall along a downward path beyond said fabric pulling means;

(b) means for lifting said fabric from its downward path, and along an upward path whereby a generally vertical fabric loop is formed, said means acting on said fabric at the top of said second upward path to open said fabric to its full width;

(c) means located along said first path and engagable by said fabric for removing twist therefrom;

(d) means located between the nadir of said fabric loop and said lifting means for detecting any twist remaining in said fabric; and (e) control means for receiving signals from said twist detecting means for controlling said twist removal means for twist removal from further fabric being processed.

6. Apparatus as set forth in claim 5 wherein rotatable support means are provided for receipt of a container of fabric to be processed, said rotatable means being operatively connected with said control means.

7. Apparatus as set forth in claim 5, wherein said twist removing means comprises a pair of freely rotatable elements located along each side of said fabric path, each of said rotatable elements having means thereon for contact with said fabric as said fabric moves along its first path.

8. Apparatus as set forth in claim 7, wherein said twist detecting means comprises a pair of cylindrical elements for receiving said fabric therebetween, each said cylindrical element being freely rotatably received on an axle disposed at a vertical angle with respect to said fabric path and means for sensing the location of said elements along said axles, said sensor means being operatively associated with said control means.

9. Apparatus as set forth in claim 8, wherein said twist detecting means is located at the point where said rope of fabric begins to diverge in spreading to its full width.

10. A method of removing twist from a fabric in rope form, comprising the steps of:

(a) moving said fabric along a first path;

(b) removing twist from said fabric as it moves along said first path;

(c) moving said fabric along a second path in a downward vertical direction for a predetermined distance;

(d) moving said fabric along a third path in an upward vertical direction, whereby said second and third paths form a fabric loop therebetween;

(e) spreading said fabric to its full open width downstream of the nadir of said loop;

(f) detecting any twist remaining in said fabric in its third path, after it passes through the nadir of said loop and before said rope is spread to its full width; and (g) controlling said twist removal means in response to twist detected in said fabric in said third path.

11. A method as set forth in claim 10, wherein said remaining twist is detected at the point said fabric begins its transition from rope form to its open form.

12. A method as set forth in claim 10, wherein said twist is removed from said fabric along said first path by contacting said fabric with diagonally opposite freely rotatable spaced-apart elements.

13. A method as defined in claim 10 wherein remaining twist in said fabric is detected by passing said fabric in said third path between and in contact with two freely rotatable cylindrical elements, said elements being angularly disposed with respect to said fabric and freely movable along said angle whereby twist remaining in said fabric will move one of said elements upwardly along its angle and wherein the location of said element will provide input to said control means as to magnitude and direction of said remaining twist.

14. A method as set forth in claim 10, wherein said first path is generally horizontal.

15. A method as set forth in claim 10, wherein twist remaining in said fabric is determined by monitoring the openness of the fabric at the detection point in said third path and the twist removal is adjusted in response to the condition of said fabric at the point it is monitored.

16. A method as set forth in claim 15, wherein said fabric is monitored generally at a point where said fabric will be substantially fully opened if all twist has been removed from said fabric.

17. The method as set forth in claim 10, wherein said fabric is supported in a container mounted on a turntable which may be revolved in either direction to assist in removal of twist from said fabric in its third path after its passes the nadir of said loop.

18. Apparatus for detecting the presence of twist in a moving fabric rope, and for measuring the direction and magnitude of any twist detected therein, comprising:

(a) a first cylindrical roll disposed on one side of said rope, at an acute angle to the longitudinal axis of said fabric rope, and in contact with said fabric rope;

(b) first means for supporting said first cylindrical roll for movement along its longitudinal axis in response to twist present in said fabric rope;

(c) a second cylindrical roll disposed on the opposite side of said fabric rope, at an acute angle to the longitudinal axis of said fabric rope and in contact with said fabric rope;

(d) second means for supporting said second cylindrical roll for movement along its longitudinal axis in response to twist present in said fabric rope; and (e) means for continuously detecting the positions of said first and second cylindrical rolls, and for generating a signal in response thereto, which is indicative of the amount and the direction of twist in said fabric rope.

19. A twist detector as set forth in claim 18, wherein the longitudinal axes of said first and second cylindrical rolls are parallel.

20. A twist detector as set forth in claim 18, wherein said acute angle is about 45° to the longitudinal axis of said fabric rope.

* * * * *